US010306353B2

(12) United States Patent
Hosoi

(10) Patent No.: US 10,306,353 B2
(45) Date of Patent: May 28, 2019

(54) ACOUSTIC IMPEDANCE MATCHING DEVICE AND LOUDSPEAKER PROVIDED WITH SUCH A DEVICE

(71) Applicant: FOCAL JMLAB, La Talaudiere (FR)

(72) Inventor: Shintaro Hosoi, Lyons (FR)

(73) Assignee: FOCAL JMLAB, La Talaudiere (FR)

( * ) Notice: Subject to any disclaimer, the term of this patent is extended or adjusted under 35 U.S.C. 154(b) by 0 days.

(21) Appl. No.: 15/561,277

(22) PCT Filed: Mar. 18, 2016

(86) PCT No.: PCT/FR2016/050615

§ 371 (c)(1),
(2) Date: Sep. 25, 2017

(87) PCT Pub. No.: WO2016/156697

PCT Pub. Date: Oct. 6, 2016

(65) Prior Publication Data

US 2018/0124501 A1 May 3, 2018

(30) Foreign Application Priority Data

Apr. 2, 2015 (FR) ..... 15 52852

(51) Int. Cl.

| | |
|---|---|
| ***H04R 1/28*** | (2006.01) |
| ***H04R 1/30*** | (2006.01) |
| ***G10K 11/00*** | (2006.01) |

(52) U.S. Cl.

CPC ..... *H04R 1/288* (2013.01); *G10K 11/002* (2013.01); *H04R 1/2865* (2013.01); *H04R 1/30* (2013.01)

(58) Field of Classification Search

CPC ..... H04R 1/30; H04R 1/345; H04R 1/2857; H04R 1/288; H04R 1/2888; H04R 1/2834; G10K 11/22; G10K 11/28; G10K 11/30; G10K 13/00; G10K 2210/112; G10K 2210/128; G10K 2210/12822

(Continued)

(56) References Cited

U.S. PATENT DOCUMENTS

| | | | |
|---|---|---|---|
| 2,293,181 | A | 8/1942 | Terman |
| 4,044,855 | A | 8/1977 | Kobayashi |

(Continued)

FOREIGN PATENT DOCUMENTS

| | | | |
|---|---|---|---|
| EP | 622777 | A1 | 11/1994 |
| WO | WO-199720307 | A1 | 6/1997 |
| WO | WO-2013016375 | A1 | 1/2013 |

OTHER PUBLICATIONS

ISA/European Patent Office International Search Report and Written Opinion for Corresponding International Application No. PCT/FR2016/050615, dated Jun. 6, 2016 in the French and English languages (13 pgs).

*Primary Examiner* — Curtis A Kuntz
*Assistant Examiner* — Julie X Dang
(74) *Attorney, Agent, or Firm* — Harris Beach PLLC

(57) ABSTRACT

The invention relates to an acoustic impedance matching device arranged so as to be mounted behind a loudspeaker. Said device comprises a chamber at least partially filled with an absorbent material. Said device is characterized in that the cross-section of the chamber increases with the distance from the loudspeaker, and the density of the absorbent material increases with the distance from the loudspeaker.

11 Claims, 3 Drawing Sheets

(58) Field of Classification Search
USPC ..... 381/354
See application file for complete search history.

(56) References Cited

U.S. PATENT DOCUMENTS

| | | | | |
|---|---|---|---|---|
| 4,139,076 | A * | 2/1979 | Hruby, Jr. | H04R 1/2811 181/148 |
| 4,410,064 | A | 10/1983 | Taddeo | |
| 4,429,762 | A | 2/1984 | Cesati | |
| 4,690,244 | A * | 9/1987 | Dickie | H04R 1/2888 181/146 |
| 6,377,696 | B1 * | 4/2002 | Nevill | H04R 1/2819 181/199 |
| 6,700,984 | B1 | 3/2004 | Holberg et al. | |
| 2007/0232710 | A1 * | 10/2007 | Yoshida | C08J 9/28 521/84.1 |
| 2009/0084624 | A1 * | 4/2009 | Dickie | H04R 1/2819 181/152 |

* cited by examiner

-1-

ACOUSTIC IMPEDANCE MATCHING DEVICE AND LOUDSPEAKER PROVIDED WITH SUCH A DEVICE

CROSS-REFERENCE TO RELATED APPLICATIONS

This application is a national stage application under 35 U.S.C. § 371 of PCT Application No. PCT/FR2016/050615, filed on Mar. 18, 2016, which claims priority to and the benefit of French Application No. 1552852 filed on Apr. 2, 2015, which are incorporated herein by reference in their entirety.

TECHNICAL DOMAIN

The invention relates to the field of acoustics, and more precisely to that of loudspeakers. More specifically it is aimed at a particular design of acoustic impedance matching device forming a cone or a horn located behind a loudspeaker.

PRIOR TECHNIQUES

In general, loudspeakers are electroacoustic devices, that include a mobile diaphragm that moves according to the audio signal to be reproduced. This mobile diaphragm generates a pressure wave by placing in motion the mass of air located at the front of the loudspeaker. In doing so, the mass of air located behind the diaphragm is also placed in motion, thus generating a pressure wave within the rear part of the speaker. In some cases, particularly if the loudspeaker is enclosed within a case, this rear wave can be reflected back to the rear face of the diaphragm and can thus disrupt the vibratory behavior thereof, which may introduce unwanted distortions and a modification to the frequency response. In order to limit or cancel these phenomena, it is known to place behind the speaker an acoustic impedance matching device, which absorbs all or part of the acoustic energy generated behind the loudspeaker.

It will be recalled that the acoustic absorption obtained within a fibrous, textile, or open cell foam type of material, is a transformation of acoustic energy into mechanical energy due to interactions between the molecules of air in motion and the structure of the material. Thus, the higher the particle speed, the greater the acoustic absorption. This is the reason why all of the previous solutions presented below are based upon a reduction in cross-section which leads to higher speed and thus greater acoustic absorption.

Different solutions have already been proposed, such as the one described in the document U.S. Pat. No. 2,293,181. This document describes an absorption device that has the form of a cone wherein the cross-section decreases from the loudspeaker connection area up to opposite end. This cross-sectional reduction, combined with the presence of absorbent material, makes it possible to effectively reduce the reflections of the rear wave towards the loudspeaker.

An equivalent solution has been described in the document U.S. Pat. No. 6,377,006 96, with a taper shaped horn. This horn also has a cross-section which decreases moving away from the speaker. This horn is completely filled with fibrous absorbent material. The motion of air located behind the diaphragm, and inside the horn causes friction with the fibrous material, and thus the absorption of acoustic energy behind the speaker.

A variant has been described in the document U.S. Pat. No. 6,700,984, wherein the shape of the horn has a cross-section which decreases overall, but with multiple local widenings and constrictions.

All of these solutions are therefore cones, the cross-section whereof decreases overall with the distance from the loudspeaker, in order to benefit from the advantages of high particle speed within the absorbent materials.

Indeed, these solutions thus make it possible to obtain very high acoustic absorption levels, but sometimes at the expense of linearity. In fact, the simultaneous use of a high particle speed and a high absorption density leads to non-linearity phenomena relating to the viscoelastic behavior of the materials used.

It will also be recalled here that the use of a high density absorbent favors acoustic absorption, but that it also favors the reflection of residual sound waves towards the rear face of the diaphragm.

The invention described below offers a solution that makes it possible to reduce all of these phenomena whilst benefiting from a good level of acoustic absorption.

DESCRIPTION OF THE INVENTION

As previously described, the premise of the study is based upon the fact that a high particle speed associated with a high absorbent density can be sources of unwanted nonlinear phenomena. The invention therefore proposes a progressive absorption solution wherein the particle speed decreases as the acoustic absorbent density increases.

The invention relates to an acoustic impedance matching device arranged so as to be mounted behind a loudspeaker, and comprising a chamber at least partially filled with an absorbent material.

This device is characterized in that the cross-section of the chamber increases with the distance from the loudspeaker. Additionally, the density of the absorbent material increases with the distance from the loudspeaker.

In other words, the invention consists in the use of a horn geometry that is opposite to those of the prior art, in order to reduce the particle velocity towards the end of the horn. However, thanks to the invention, the quantity and density of the absorbent material filling the horn increase with the distance from the loudspeaker, which compensates for the drop in particle speed in terms of acoustic absorption.

In other words, the invention consists in controlling the acoustic absorption phenomena by means of the presence of an absorbent which is of a relatively low density in the immediate proximity of the loudspeaker, and which becomes denser towards the opposite end.

The Applicant has found that absorbent materials, particularly fibrous materials, due to the viscoelastic effect of the fibers, do not exhibit linear acoustic behavior.

By virtue of the configuration of the invention, particularly the low density of the absorbent material near the loudspeaker, the friction phenomena of the air at the entrance to the horn are reduced and the acoustic absorption within the horn is more gradual. The low density of the absorbent material near the entrance to the horn limits the sound reflection phenomena. The absorption is, however, effectively then ensured by a higher density of the absorbent material when the acoustic waves advance within the horn. The widening of the cross-section of the horn reduces the speed of air within the area wherein the absorbent material is more dense, thus limiting nonlinear phenomena whilst ensuring satisfactory absorption.

In summary, the progressive and simultaneous variation of the absorbent density and particle speed makes it possible for the invention to limit reflection phenomena, to benefit from a good level of sound acoustic and to reduce those nonlinearities that are inherent to the use of materials such as fibrous, textile and open cell foams.

Better conservation of the acoustic performance of the loudspeaker is thus noted regardless of the sound level.

Different configurations, geometries and designs can be envisaged.

Depending upon the type of loudspeaker used and the performance to be obtained in terms of absorption, the absorbent material can fill the entire chamber, or only part of said chamber.

According to another characteristic of the invention, the end of the chamber opposite the loudspeaker may be either closed or open. Each of the two solutions has distinct advantages. The open solution allows for a complete lack of sound wave reflection towards the rear face of the diaphragm of the loudspeaker, which improves performance in terms of acoustic absorption. It is to be noted, however, that a residual part of the rear wave can be found outside the device, that is to say the listening space, and can therefore be superimposed upon the wave front generated by the loudspeaker, which may in some cases slightly interfere with the acoustic response of the device. This drawback can however be considered marginal in view of the good sound absorption performance.

The solution with a closed horn ensures the complete absence of the rear wave within the listening space. This can be an advantage in some configurations, even though the residual part of the rear wave that will not be totally absorbed by the device will be reflected against the closed wall and may slightly interfere with the vibrational behavior of the diaphragm of the loudspeaker. The choice of an open or closed solution will therefore be based upon other parameters such as the type of loudspeaker concerned (tweeter, midrange, woofer), the type of case used, and finally the type of acoustic housing to be implemented.

With regard to the density ratios of the absorbent materials used, in practice good results are observed when the ratio between the maximum and minimum densities of the absorbent material is greater than five. In other words, the density of the absorbent material is five times greater at the end of the horn opposite the loudspeaker compared to the density of the absorbent material at the entrance to the horn.

Similarly, the ratio between the maximum and minimum cross-sections of the chamber is preferably greater than five. In other words, the horn cross-section widens at a ratio greater than five, between the entrance to the horn on the loudspeaker side and the opposite end. It should be noted that this cross-sectional increase can be implemented in one or two directions, in such a way that the overall size of the horn is not excessive.

In practice, the absorbent material is generally selected from fibrous materials, textiles and open cell foams.

It is possible to use a material which has been manufactured with the required density progression. It is also possible to use a material of homogeneous density wherein the progression is obtained during the manufacture of the chamber itself. In this case, the chamber has two walls between which the absorbent material is located, the two walls having parallel external faces and non-parallel internal faces. When the material of homogeneous density is compressed between the two walls, the external faces of which are held in parallel, the compression is performed with a progression that generates the required spatial variation of density.

The invention also relates to an assembly consisting of a loudspeaker and an acoustic absorption device as described above. In practice, in order to ensure continuous impedance variation, those solutions will be preferred wherein the entrance to the chamber has a cross-section that is substantially equal to the cross-section behind the loudspeaker. In other words, the characteristic chamber is to be found in the extension of the opening behind the loudspeaker through which the air moved by the diaphragm is expelled.

In practice, the combination of the loudspeaker and the horn may include an additional connecting element, connecting the mounting area to the loudspeaker and the chamber itself, in such a way that the difference in cross-section between the connecting area and the entrance to the chamber is as gradual as possible, and such that cross-sectional steps, which are sources of spurious reflections, are avoided.

It is also possible for the loudspeaker to be incorporated into an enclosure, and in this case, the absorption chamber is mounted onto the enclosure. Preferably, the shape of the enclosure and the opening of the chamber are selected in such a way that the cross-section presented to the acoustic waves is as gradual as possible, and limits parasitic reflection phenomena.

BRIEF DESCRIPTION OF THE DRAWINGS

The method for implementing the invention and the advantages thereof will become more apparent from the following disclosure of embodiments, supported by the attached figures wherein.

DETAILED DESCRIPTION

As already mentioned, the invention relates to an acoustic impedance matching device which is designed to be installed behind a loudspeaker. Different configurations can be envisaged, in particular the one illustrated in FIG. 1.

Figure 1:
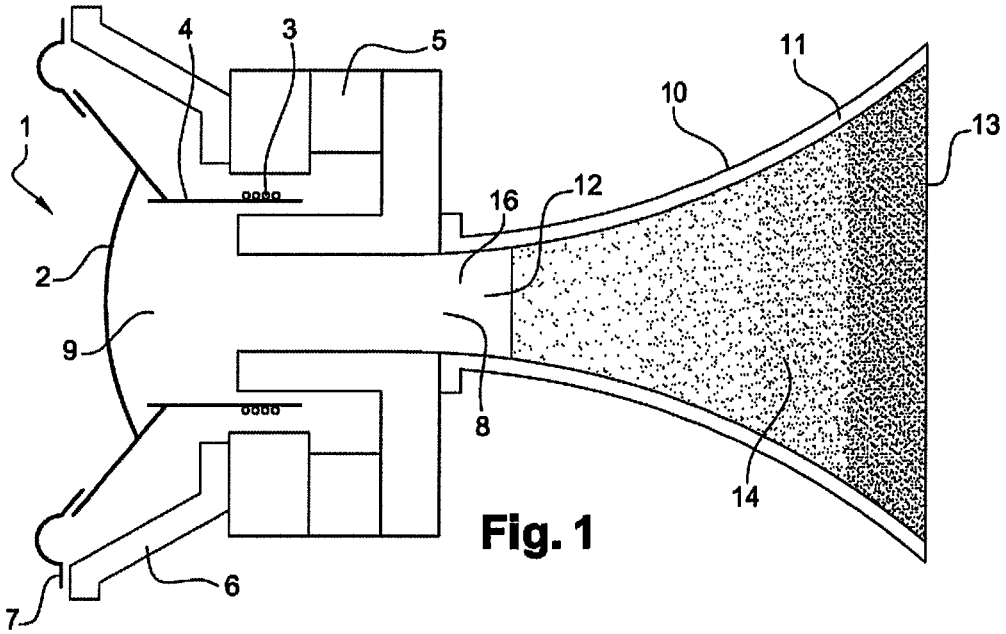
FIG. 1 is a simplified longitudinal section of a loudspeaker driver associated with an acoustic matching device according to the invention.

The system illustrated in FIG. 1 comprises a loudspeaker 1 which schematically includes a diaphragm 2 movable in relation to a frame 6, by means of the suspension member 7. The diaphragm 2 comprises, at the center thereof, a cylinder 4 whereupon a coil 3 is mounted and through which a current passes representing the sound signal to be reproduced. Said coil 3 is immersed in a magnetic field generated by the magnetic driver 5. Said magnetic driver has an opening 8 oriented towards the rear, in such a way that the volume 9 located behind the diaphragm 2 communicates with the outside of the loudspeaker.

At said opening 8 the presence is noted of the impedance matching device 10. Said device comprises a horn 11 the end whereof has a smaller cross-section 12 and is connected to the opening 8 behind the loudspeaker 1. According to the invention, the cross-section at the opening 12 located on the loudspeaker side 1 is less than the cross-section at the opposite end 13. In the embodiment illustrated, the end 13 is open, but it is possible for it to be closed, thus preventing any outflow of air.

According to the invention, the interior volume of the horn 11 is filled with an absorbent material 14, which can be a fibrous material, based, for example upon glass fibers, on synthetic fibers, or alternatively based upon an open cell foam, or more generally any material consisting of elementary particles capable of moving under the effect of the air flow generated by the movement of the diaphragm, and in so doing absorbing part of this acoustic energy.

In the embodiment illustrated, the filler material 14 occupies only a fraction of the horn, leaving empty a part 16 at the entrance to the horn. This region 16 thus forms an extension to the volume behind the loudspeaker, thus limiting compression, and facilitating the operation of the loudspeaker at low frequencies. In other embodiments, the absorbent material may also fill the entire volume of the horn.

According to one characteristic of the invention, the filler material is installed within the horn such that the density thereof increases leading from the end 12 near the loudspeaker in the direction of the opposite end 13. In this way, the damping effect is progressive, and the impact of the absorbent material on acoustic waves at the beginning of the horn is less than it is near the opposite end 13.

Preferably, the damping material 14 is a homogeneous material that is progressively subjected to compression up to the end 13 of the horn. It is however possible in some embodiments to use several different materials, having therefore increasing densities, or more generally gradual absorption capabilities, which are arranged as superimposed layers within the horn.

Figure 2:
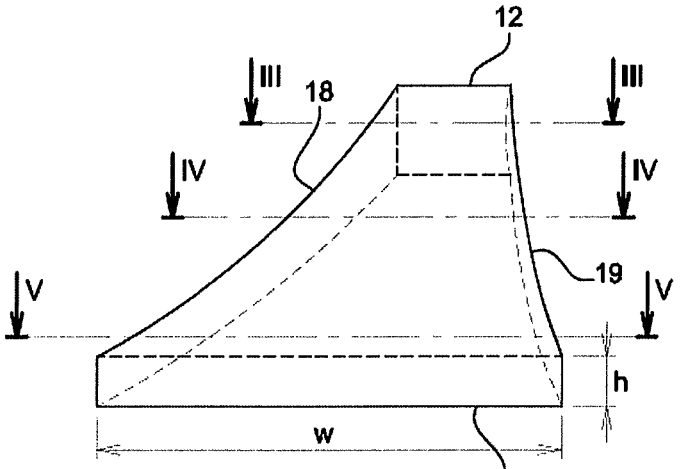
FIG. 2 is a summary perspective view of the acoustic matching device of FIG. 1.

FIG. 2 illustrates a configuration of the shape of the horn 14. More specifically, the horn has a rectangular cross-section, the width w and height h whereof vary between the end 12 that is to be connected to the back of the loudspeaker and the free end 13.

Figure 3:
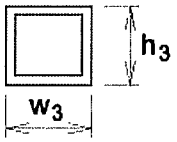
FIGS. 3, 4 and 5 are cross-sectional views of the device of FIG. 2, respectively according to sectional planes III-III', IV-IV', V-V'.
Figure 4:
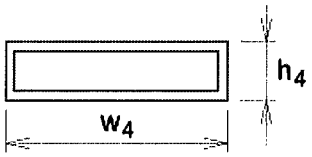
Figure 5:
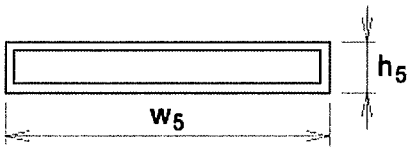

It is noted as shown in FIGS. 3, 4 and 5, that the width w of this section increases moving away from the loudspeaker ($w_3<w_4<w_5$), while at the same time, the height h decreases ($h_3>h_4>h_5$). Said height decreases less quickly than the width increases, in such a way that the overall cross-section ($w \times h$) increases moving away from the loudspeaker.

Figure 6:
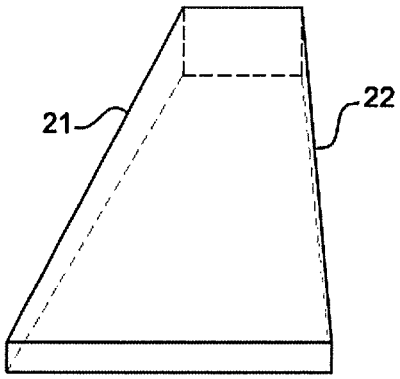
FIGS. 6 and 7 are summary perspective views of alternative embodiments of the acoustic matching device

Different laws of increase can be envisaged for different parameters, making it possible to obtain the required increase of the section. Thus, as illustrated in FIG. 6, the width and height can linearly increase and decrease respectively. Thus, the lateral flanks 21, 22 of the horn have a substantially planar geometry, compared with the concave geometry, with an outwardly oriented curvature towards the side walls 18, 19 of the horn of FIG. 2, which demonstrate an exponential or similar type of cross-section increase.

Figure 7:
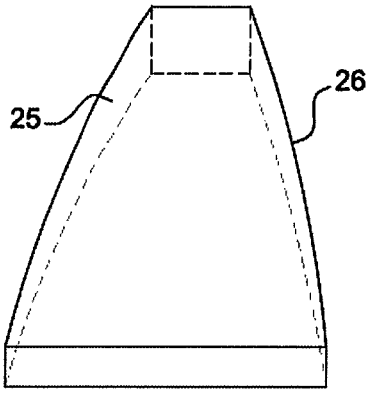

Conversely, as shown in FIG. 7, the horn may have such a shape that the side walls thereof are convex, that is to say a short inwardly directed curvature, corresponding to an increase of parameters of the logarithmic, parabolic or similar type.

Figure 8:
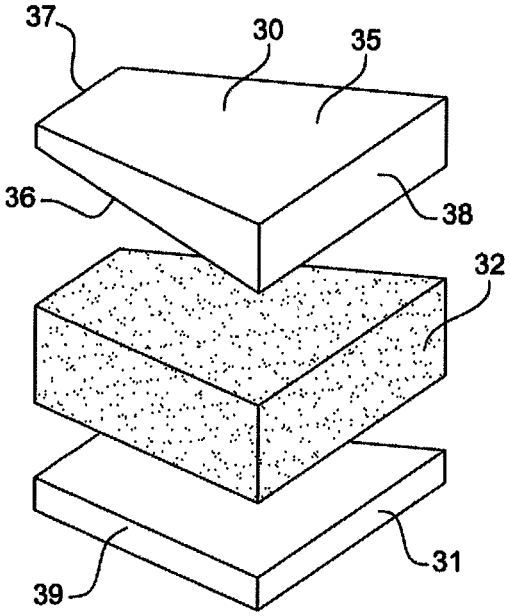
FIGS. 8 and 9 are schematic perspective views showing the various components of an alternative embodiment of the acoustic matching device, respectively before and after assembly.
Figure 9:
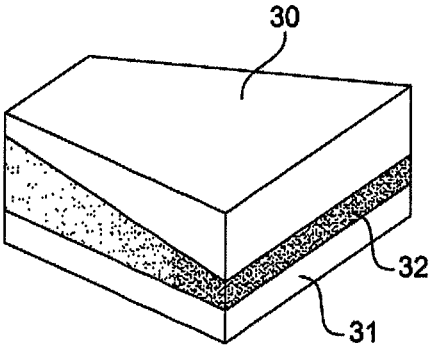

The progressiveness of the density of the absorbent material inserted into the horn can be obtained in different ways, and particularly as illustrated in FIGS. 8 and 9. In this case, the main faces 30,31 of the horn are assembled around a layer of an absorbent material 32 of uniform thickness. More specifically, one of the walls, for example the top wall 30 has a variable thickness, insofar as the upper and lower faces 35 and 36 thereof are not parallel. More specifically, this thickness increases between the back 37, intended to come in contact with the loudspeaker, and the front 38 located opposite the loudspeaker.

The opposite wall 31 has a constant thickness, in such a way that the upper face 39 thereof and the lower face 36 of the other wall 30 define a volume with an increasing cross-section moving away from the speaker. The layer 32 is produced from a homogeneous material, while the two walls 30, 31 are brought together, keeping the external faces thereof parallel, the intermediate layer 32 then being compressed to a greater extent within the area intended to be furthest from the speaker.

The law of variation of the density of the absorbent material can be determined depending upon the required performance in accordance with the variation of the cross-section of the horn. This compression can thus be linear, exponential, or inverse logarithmic.

Figure 10:
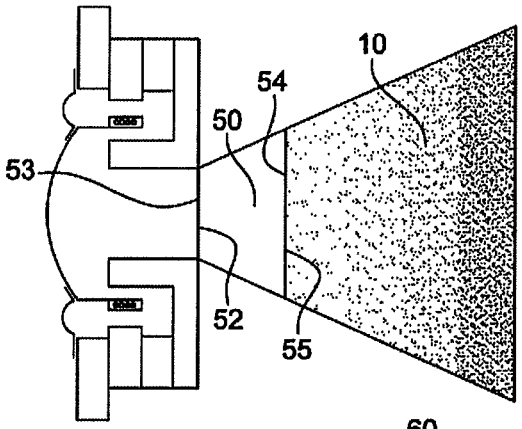
FIGS. 10, 11 and 12 are longitudinal sectional views of three alternative embodiments of a loudspeaker with an acoustic matching device according to the invention.

According to another aspect of the invention, the acoustic impedance matching device may be connected to the loudspeaker either directly as shown in FIG. 1, or by means of an additional volume, which as shown in FIG. 10 may be formed by an additional component 50 of a frustoconical shape, the cross-section of the input 52 whereof corresponds to the cross-section of the opening 53 located behind the loudspeaker 1, and the cross-section of the output 54 corresponds to that of the input 55 to the chamber 10. In this way, the progression of the cross-section of the chamber is in a sustained manner prolonged by that of the additional element. Of course, the shapes and dimensions of the additional element may vary depending upon the geometry of the loudspeaker and the chamber.

Of course, the shape of the tubular portion may be variable, according to the connected areas, and can conform to a frustoconical shape or a shape more generally flared in one direction or the other. Said connecting piece 50 may also have cross-sections of different geometries between the input and output thereof. In particular, this may be the case where the loudspeaker has a circular decompression opening, and the acoustic matching device has a rectangular inlet cross-section.

It is also possible that the impedance matching device is not directly connected to the opening behind the magnetic driver, but to an opening formed in the rear of an enclosure for the loudspeaker.

Figure 11:
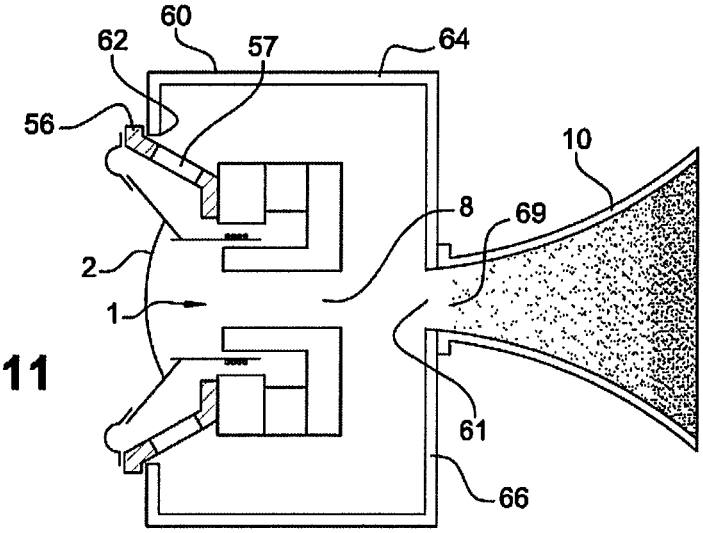

Thus, as shown in FIG. 11, the loudspeaker 1 is mounted within an enclosure 60. Said enclosure 60 has an opening 62 whereto the frame 56 of the loudspeaker 1 is attached. The enclosure has a wall 64 of a substantially constant cross-section, for example rectangular or cylindrical, around the loudspeaker. The rear wall 66 of the enclosure 60 has an opening 61 with dimensions that are substantially equal to those of the end 69 of the horn 10. This type of assembly is particularly suitable for loudspeakers wherein the frame 56 is perforated, in such a way that the volume of air behind the diaphragm 2 communicates with the outside of the loudspeaker not only through the decompression opening 8 of the magnetic driver, but also through the perforations 57 in the frame 56. In this case, the acoustic waves generated by the movement of the diaphragm and which propagate from the rear thereof are confined to within the enclosure 60, and reach the characteristic horn 10.

Figure 12:
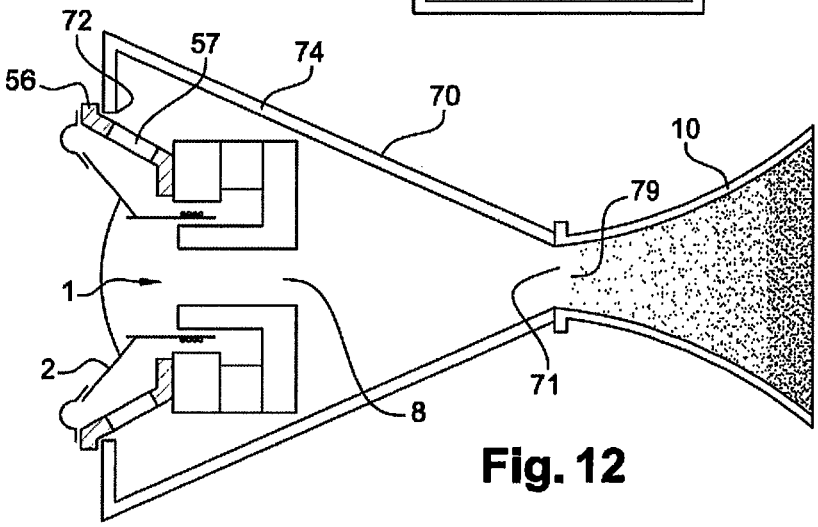

An alternative embodiment illustrated in FIG. 12 is composed of an enclosure 70, wherein the opening 72 receives the perforated frame 56 of the loudspeaker 1. The main wall 74 of the enclosure 70 is frustoconical in shape and terminates at the rear, with an opening 71. Said opening 71 also has dimensions that are suitable for the connection of an acoustic matching device 10. The frustoconical shape of the enclosure 70 allows for a progressive cross-section as seen by the acoustic waves, with a positive influence on reflection phenomena. Of course, the main wall of the enclosure may adopt various other shapes. A shape may be envisaged with a substantially constant cross-section, for example cylindrical or parallelepiped, with a characteristic horn the opening whereof is of suitable geometry, and that may especially have a cross-section that is similar to that of the enclosure.

It is obvious that the invention can also be applied to loudspeakers that have a magnetic driver that is not pierced at the center thereof, and wherein the air present behind the diaphragm passes only through the openings formed in the frame.

It follows from the foregoing that the impedance matching device according to the invention has the advantage of providing the near absence of the reflection of sound waves on the rear of the loudspeaker diaphragm, while reducing the non-linearities inherent in the routine use of high-density absorbent materials. Indeed, the progression of the absorbing effect due to the increasing density of the filler material causes the speed of the particles of air coming into contact with this absorbent material to be lower than in the prior art.

The improvements obtained are reflected in particular by a reduction in distortion and better conservation of the acoustic performance of the loudspeaker regardless of the sound level.

The invention claimed is:

1. Acoustic impedance matching device arranged so as to be mounted behind a loudspeaker, comprising a chamber at least partially filled with an absorbent material, characterized in that:

the cross-section of the chamber increases progressively with the distance from the loudspeaker;

the density of the absorbent material progressively increases with the distance from the loudspeaker; and wherein the device's acoustic impedance is progressively increasing starting from the loudspeaker.

2. Device according to claim 1, wherein the absorbent material fills the entire chamber.

3. Device according to claim 1, wherein the absorbent material fills only a part of the chamber.

4. Device according to claim 1, wherein the end of the chamber opposite the loudspeaker is closed.

5. Device according to claim 1, wherein the end of the chamber opposite the loudspeaker is open.

6. Device according to claim 1, wherein the ratio between the maximum and minimum densities of the absorbent material is greater than five.

7. Device according to claim 1, wherein the ratio between the maximum and minimum sections of the chamber is greater than five.

8. Device according to claim 1, wherein the absorbent material is selected from the group consisting of fibrous materials and open cell foams.

9. Device according to claim 1, wherein it has two walls between which the absorbent material is located, the two walls having parallel external faces and non-parallel internal faces.

10. Assembly formed by a speaker and a device according to claim 1, wherein it has a connection element connecting the loudspeaker and the chamber.

11. Assembly according to claim 10, wherein the entrance to the chamber has a cross-section substantially equal to the cross-section behind the loudspeaker.

* * * * *